US006470533B1

(12) United States Patent
Comstock

(10) Patent No.: US 6,470,533 B1
(45) Date of Patent: Oct. 29, 2002

(54) UNIVERSALLY ROTATING PIVOTAL LUGGAGE HANDLE

(76) Inventor: Troy C. Comstock, 31 Trail Edge Cir., Powell, OH (US) 43065

( * ) Notice: Subject to any disclaimer, the term of this patent is extended or adjusted under 35 U.S.C. 154(b) by 0 days.

(21) Appl. No.: 09/498,744

(22) Filed: Feb. 7, 2000

(51) Int. Cl.[7] ..... A45C 13/36
(52) U.S. Cl. ..... 16/445; 16/406; 16/422
(58) Field of Search ..... 16/445, 406, 422, 16/425, 411, 430, 426, 408, 428, 114.1, 113.1; D8/14; 294/150, 154, 156

(56) References Cited

U.S. PATENT DOCUMENTS

| | | | | | |
|---|---|---|---|---|---|
| 504,307 | A | * | 8/1893 | Roberts | 294/154 |
| 3,191,830 | A | * | 6/1965 | Goez | 294/156 |
| 4,402,542 | A | * | 9/1983 | Kreutzer | 294/156 |
| 4,656,566 | A | * | 4/1987 | Kelley | 16/422 |
| 4,696,077 | A | * | 9/1987 | Kim | 16/114.1 |
| 4,832,393 | A | * | 5/1989 | Pitchford | 294/156 |
| 5,265,307 | A | | 11/1993 | Hull et al. | |
| D342,427 | S | * | 12/1993 | Stovall | D8/14 |
| 5,353,900 | A | | 10/1994 | Stilley | |
| 5,464,080 | A | | 11/1995 | Liang | |
| 5,564,538 | A | | 10/1996 | Sadow | |
| 5,566,870 | A | * | 10/1996 | Mejeur | 294/150 |
| 5,680,677 | A | * | 10/1997 | Lovell | 16/430 |
| 5,722,118 | A | * | 3/1998 | Hansen et al. | 16/113.1 |
| 5,813,504 | A | | 9/1998 | Imy et al. | |
| 5,876,048 | A | | 3/1999 | Lee et al. | |
| 5,878,853 | A | | 3/1999 | DeRouen et al. | |
| 5,890,570 | A | | 4/1999 | Sadow | |

* cited by examiner

*Primary Examiner*—Anthony Knight
*Assistant Examiner*—Doug Hutton
(74) *Attorney, Agent, or Firm*—Kremblas, Foster, Phillips & Pollick

(57) ABSTRACT

A universal luggage handle is provided for use with luggage to effectuate the moving of the luggage, with the luggage handle including a hand grasp, an intermediate member rotatably secured to the hand grasp, and a strap portion, with the strap portion secured to the intermediate member, and with the strap portion having fastening means to secure the strap portion to itself. The intermediate member has a base portion and at least one strap attachment portion. The hand grasp pivots relative to the intermediate member. The intermediate member has a gasket surrounding a section of the strap attachment portion, with the gasket being in contact with strap attachment portion, and with the gasket being in contact with the strap portion. The strap portion has a first side and a second side, with the first side being generally planar, but preferably having a raised portion. In the preferred embodiment of the invention, the hand grasp is separated from the intermediate member by a grommet. More preferably, this grommet is fabricated from rubber. Each strap attachment portion has a longitudinal axis of attachment associated therewith, such that the strap portion freely rotates about the longitudinal axis. Several modified embodiments are disclosed.

14 Claims, 4 Drawing Sheets

UNIVERSALLY ROTATING PIVOTAL LUGGAGE HANDLE

FIELD OF THE INVENTION

The present invention relates generally to luggage handles, and more particularly, to such handles that are used with wheeled luggage which provides enhanced directional control as the luggage is pulled by a person wishing to steer the luggage in a particular direction on an underlying surface.

BACKGROUND OF THE INVENTION

This invention is directed to the providing of a device for use as a universally rotatable and pivotable luggage handle for use with wheeled suitcases. Wheeled articles of luggage are well known in the art. Such cases typically incorporate a retractable handle that when extended can be used to guide or tow the case, the case being provided with ground-engaging wheels to permit it to more easily traverse an underlying surface.

Such wheeled cases, in addition to being provided with wheels, also typically have an extendable handle which can be projected from the luggage for tilting the baggage on its wheels for subsequent pulling. The extendable, retractable handle has a transverse portion for grasp by a hand, such that the closed fingers of the hand about the handle form a fist which faces either forward to rearward with respect to the torso of the individual pulling the luggage.

A person who has done much travel recognizes the difficulties associated with the guiding or towing of luggage, especially pieces of large size. This problem becomes acute when it becomes necessary to change direction. Attempts to address the problem have normally taken one of two approaches. The first approach is to design a better suitcase. Liang, U.S. Pat. No. 5,464,080,discloses a universally pivotal luggage steering apparatus incorporated into the piece of luggage. A ball and socket arrangement located at the base of the luggage is set forth as a solution to the problem. Sadow, U.S. Pat. No. 5,890,570, discloses a wheeled carry-on case. Two embodiments show various placement of the handles however while this assists in the forward and backward movement of the luggage, it does not address the pivotal maneuvering of the luggage.

The other approach to the problem has been attempts to design a better handle. Hull et al, U.S. Pat. No.5,265,307, discloses an ergonomic adjustable handle. The handle base may be fixedly secured to a piece of baggage. The actual grasping portion of the handle may then be adjusted relative to the base and then secured in relationship thereto in the supposedly optimal position. However, although ergonomic considerations are addressed, there is no pivoting or rotating of the handle relative to the baggage to which it is attached. DeRouen, U.S. Pat. No. 5,878,853, discloses a luggage pull with various embodiments. The luggage pull is secured to the baggage so that the tubular grasping portion of the handle can be rotated 90° relative to the handle portion on the retractable handle member so as to position the hand grasping the luggage pull in a normal position relative to the torso for pulling the bag by transmitting a pulling force through the luggage pull to the handle portion of the bag itself. Even with existing handles, trying to change direction may necessitate the lifting of the bag off of the ground in order to complete the turn, or result in the bag tipping over due to a failure in the making of a sudden, sharp turn.

It is thus apparent that the need exists for an improved luggage handle for use with wheeled luggage, which handle provides enhanced directional control as the luggage is pulled by a person wishing to steer the luggage in a particular direction on an underlying surface, especially when there is a change in direction.

SUMMARY OF THE INVENTION

In accordance with this invention there is disclosed a universal luggage handle for use in cooperation with a piece of luggage to effectuate the moving of the luggage, with luggage handle including a hand grasp, an intermediate member rotatably secured to the hand grasp, and a strap portion secured to the intermediate member, and itself comprising fastening means to secure the strap portion to itself. The intermediate member has a base portion and at least one strap attachment portion. The hand grasp pivots relative to the intermediate member. The intermediate member also has a gasket surrounding a section of the strap attachment portion, with the gasket being in contact with the strap attachment portion and also being in contact with the strap portion. Each strap attachment portion has a longitudinal axis of attachment associated therewith, with the strap portion being free to rotate about such longitudinal axis.

The strap portion has a first side and a second side, with the first side being generally planar, but in the preferred embodiment of the invention having a raised portion. The hand grasp is separated from the intermediate member by a grommet, with the grommet preferably being fabricated from rubber.

There is also disclosed a universal luggage handle for use in cooperation with a piece of luggage to effectuate the moving of the luggage, with the luggage handle including a hand grasp, an intermediate member rotatably secured to the hand grasp, with the hand grasp separated from the intermediate member by a grommet, and with the intermediate member having a base portion and at least one strap attachment portion, and with the luggage handle also including a strap portion secured to the intermediate member, and with the strap portion having fastening means to secure the strap portion to itself, and with each strap attachment portion having a longitudinal axis of attachment associated therewith, and with the strap portion free to rotate about the longitudinal axis.

The hand grasp pivots relative to the intermediate member. The grommet preferably is fabricated from rubber. The intermediate member has a gasket surrounding a section of the strap attachment portion, and with the gasket being in contact with the strap attachment portion, as well as the gasket being in contact with the strap portion. The strap portion has a first side and a second side, with the first side being generally planar, but having a raised portion.

There is also disclosed in combination a wheeled piece of luggage having a handle and a universal luggage handle secured to such handle to effectuate the moving of the luggage, with the luggage handle including a hand grasp, an intermediate member rotatably secured to the hand grasp, and a strap portion, with the strap portion secured to the intermediate member, with the strap portion comprising fastening means to secure the strap portion to itself, and with the strap portion when secured to itself also securing the handle to the luggage handle. The intermediate member has a base portion and at least one strap attachment portion. The hand grasp pivots relative to the intermediate member. The intermediate member has a gasket surrounding a section of the strap attachment portion, with the gasket being in contact with the strap attachment portion, and with the gasket being in contact with the strap portion. The strap portion has a first side and a second side, with the first side being generally planar, but having a raised portion, and with the raised portion being in contact with the handle when the handle is secured to the luggage handle.

The hand grasp is separated from the intermediate member by a grommet. The strap attachment portion has a longitudinal axis of attachment associated therewith, with the strap portion being free to rotate about the longitudinal axis.

The primary objective of this invention is to provide a device to assist in the pulling of luggage, which device permits the luggage to which it is attached to pivot easily, especially when there is a sudden change of direction.

Another objective of this invention is to provide a device to assist in the pulling of luggage, which device can be attached to the handle of luggage relatively quickly and which device is easy to use.

Still another objective of this invention is to provide a device to assist in the pulling of luggage, which device is of relatively economical construction.

Other objects and advantages of the invention will be apparent from the following description, the accompanying drawings, and the appended claims.

DETAILED DESCRIPTION OF THE DRAWINGS

Figure 1:
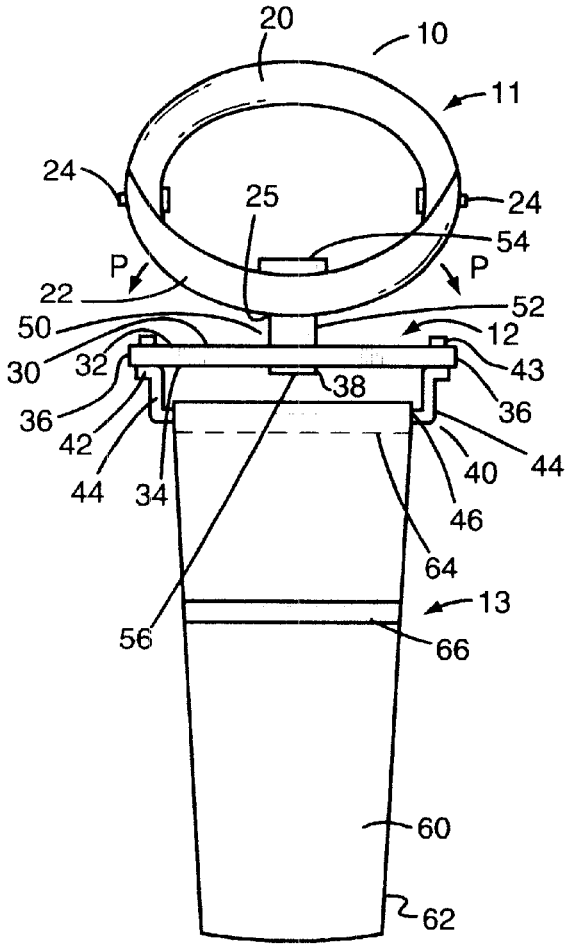
FIG. 1 is a front elevational view of a universal luggage handle made in accordance with the present invention.

Having reference to the drawings, attention is directed first to FIG. 1 which discloses a universal luggage handle made in accordance with the invention designated generally by the numeral 10. The universal luggage handle of this invention can be appreciated as generally being comprised of a handle 11, an intermediate member 12, and a strap portion 13.

Figure 2:
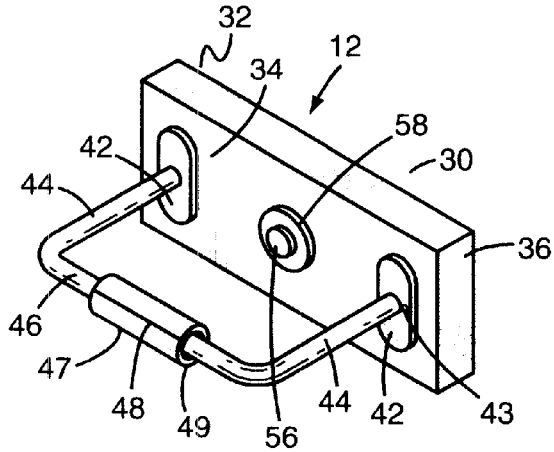
FIG. 2 is a perspective view of the intermediate member of the luggage handle disclosed in FIG. 1 without either the hand grasp or the strap portion, but with the fastening means in contact with the intermediate member, which fastening means secures the intermediate member to the hand grasp.

A more careful consideration of the hand grasp 11 discloses that it features a hand contacting portion 20 connected to a base portion 22 by fasteners 24. Additionally, base portion 22 has formed at its midpoint an aperture 25. With respect to intermediate member 12, a comparison of FIGS. 1 and 2 discloses that it features a first portion 30 having a top 32, bottom 35, and ends 36. At the center of first portion 30 is formed an intermediate member aperture 38. Intermediate member 12 also features a second portion 40 having a base 42 secured with fasteners 43 to the first portion 30 near each of the ends 36. Side portions 44 extend between each base 42 and crossbar or strap attachment portion 46 over which a longitudinal gasket 47 has been slipped so as to encase the crossbar. To facilitate the insertion of the crossbar 44 into the interior of the gasket, the sidewall of the gasket is provided with a slit 48, such that the exterior of the crossbar comes into contact with the interior surface 49 of the gasket 47.

Fastening means 50 take the form of a grommet 52, positioned between the hand grasp and the intermediate member, and a post 56 with top 54 and bottom flange 58. In operative position, the fastening means 50 permits hand grasp 11 to rotate freely throughout 360° relative to the intermediate member 12. To phrase it another way, the hand grasp can be made to spin atop the intermediate member. Furthermore, the inclusion of rubber as the composition of choice for the grommet permits the hand grasp to pivot about the intermediate member as indicated by arrows P. Finally, strap portion 13 is fabricated from a fabric comprised in whole or in part of a hook and loop type of fastener substance known in the trade as VELCRO. The strap portion has a first side 60 and a second side 62 secured together by an appropriate fastening means 64 such a stitches or adhesive. Also it will be appreciated that first side 62 is shown as having a raised area 66 formed by gathering the fabric together in a manner well known in the sewing art, with this gathering perhaps being better appreciated with reference to FIG. 4, although the raised areas of each embodiment is similarly formed.

In this embodiment of the invention, the hand grasp is formed of fabric, the intermediate member of metal or plastic, and the fasteners and strap portion of metal or plastic, and fabric respectively.

Figure 3:
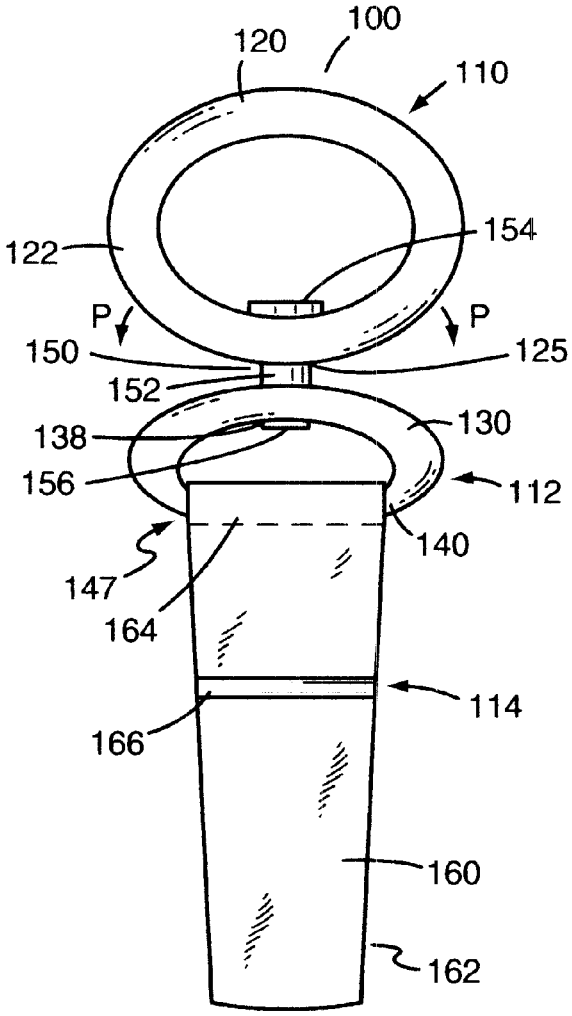
FIG. 3 is a front elevational view of a first modified embodiment of a universal luggage handle made in accordance with the present invention.
Figure 4:
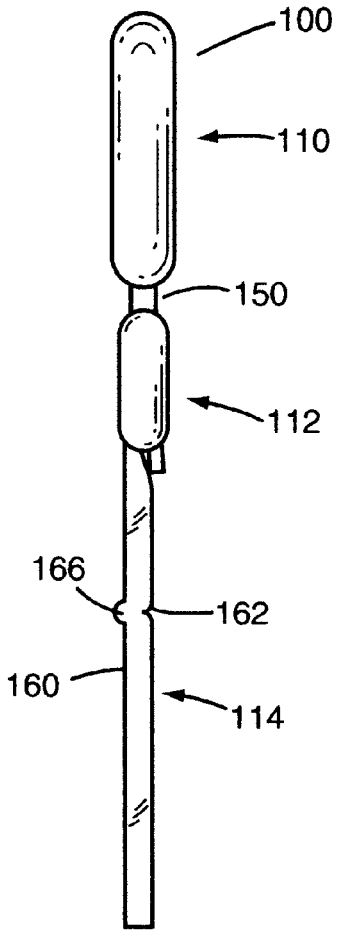
FIG. 4 is a side elevational view taken from the right side of FIG. 3.

Turning now to the modified embodiment of the invention 100 as is shown in FIGS. 3–4, it can be appreciated as generally being comprised of a handle 110, an intermediate member 112, and a strap portion 114.

A more careful consideration of the hand grasp 110 discloses that it features a hand contacting portion 120 and a base portion 122. As opposed to the luggage handle of FIG. 1, this handle is preferably molded of plastic. Additionally, base portion 122 has formed at its midpoint an aperture 125. With respect to intermediate member 112, a comparison of FIGS. 3 and 4 discloses that it features a first portion 130 at the center of which first portion 130 is formed an intermediate member aperture 138. Intermediate member 112 also features a second portion 140 over which a longitudinal gasket 147 has been slipped so as to encase the strap attachment portion of the second portion. To facilitate the insertion of the strap attachment portion 144 into the interior of the gasket, the sidewall of the gasket 147 is provided with a slit not shown, but similar to 48, such that the exterior of the crossbar comes into contact with the interior surface of the gasket, just like in the embodiment discussed with reference to FIG. 1.

Fastening means 150 take the form of a grommet 152, positioned between the hand grasp and the intermediate member, and a post 156 with top 154 and bottom flange (not shown). In operative position, the fastening means 150 permits hand grasp 111 to rotate freely throughout 360° relative to the intermediate member 112. To phrase it another way, the hand grasp can be made to spin atop the intermediate member. Furthermore, the inclusion of rubber as the composition of choice for the grommet permits the hand grasp to pivot about the intermediate member as indicated by arrows P. Finally, strap portion 114 is fabricated from a fabric comprised in whole or in part of a hook and loop type of fastener substance known in the trade as VELCRO. The strap portion has a first side 160 and a second side 162 secured together by an appropriate fastening means 164 such a stitches or adhesive. Also it will be appreciated that first side 162 is shown as having a raised area 166 formed by gathering the fabric together in a manner well known in the sewing art, with this gathering best appreciated with reference to FIG. 4.

In this embodiment of the invention, the hand grasp is formed of molded plastic, the intermediate member of metal or plastic, and the fasteners and strap portion of metal or plastic, and fabric respectively.

Figure 5:
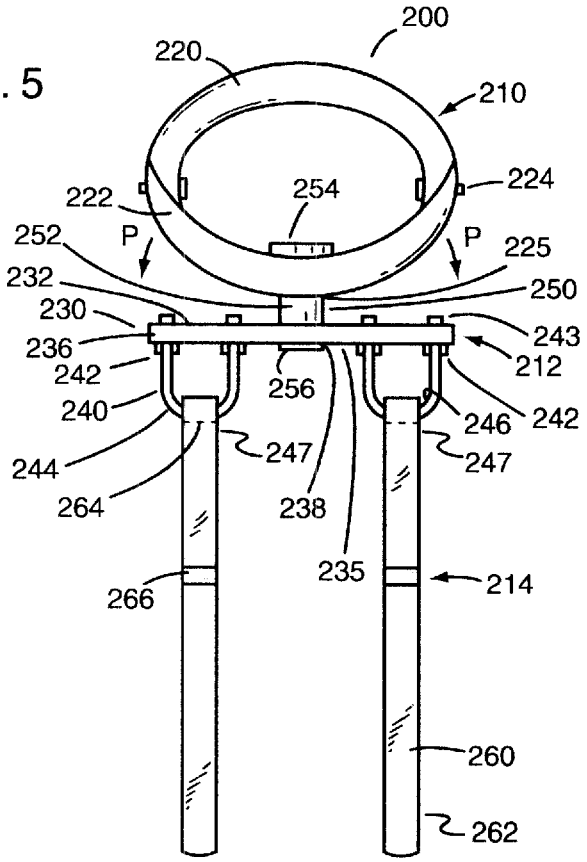
FIG. 5 is a front elevational view of a second modified embodiment of a universal luggage handle made in accordance with the present invention.

Turning now to the second modified embodiment of the invention 200 as is shown in FIG. 5, it can be appreciated as generally being comprised of a handle 210, an intermediate member 212, and a strap portion 214.

A more careful consideration of the hand grasp 210 discloses that it features a hand contacting portion 220 connected to a base portion 222 by fasteners 224. Additionally, base portion 222 has formed at its midpoint an aperture 225. With respect to intermediate member 212, a comparison of FIGS. 1 and 2 discloses that it features a first portion 230 having a top 232, bottom 235, and ends 236. At the center of first portion 230 is formed an intermediate member aperture 238. Intermediate member 212 also features a two second portions 240 having a base 242 secured with fasteners 243 to the first portion 230 near each of the respective ends 236. Side portions 244 extend between each base 242 and crossbar or strap attachment portion 246 over which a longitudinal gasket 247 has been slipped so as to encase the crossbar. To facilitate the insertion of the crossbar 246 into the interior of the gasket, the sidewall of the gasket is provided with a slit similar to 48, such that the exterior of the crossbar comes into contact with the interior surface of the gasket 247.

Fastening means 250 take the form of a grommet 252, positioned between the hand grasp and the intermediate member, and a post 256 with top 254 and bottom flange 258. In operative position, the fastening means 250 permits hand grasp 210 to rotate freely throughout 360° relative to the intermediate member 212. Or put another way, the hand grasp can be made to spin atop the intermediate member. Furthermore, the inclusion of rubber as the composition of choice for the grommet permits the hand grasp to pivot about the intermediate member as indicated by arrows P. Finally, strap portion 214 is fabricated from two strips of a fabric comprised in whole or in part of a hook and loop type of fastener substance known in the trade as VELCRO. Each strap portion has a first side 260 and a second side 262 secured together by an appropriate fastening means 264 such as stitches or adhesive. Also it will be appreciated that first side 262 is shown as having a raised area 266 formed by gathering the fabric together in a manner well known in the sewing art, with this gathering perhaps being better appreciated with reference to FIG. 4.

In this embodiment of the invention, the hand grasp is formed of fabric, the intermediate member of metal or plastic, and the fasteners and strap portion of metal or plastic, and fabric respectively. In other words, the components of this invention are the same as for the first embodiment, with the only difference being in the number of straps, with the separated straps being necessary for those handles which have a release mechanism at the center of the handle.

Figure 6:
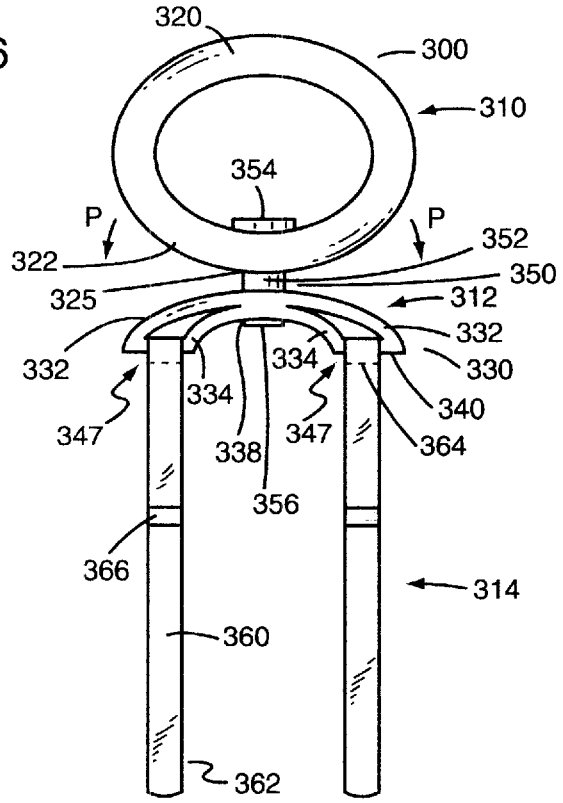
FIG. 6 is a front elevational view of a third modified embodiment of a universal luggage handle made in accordance with the present invention.

Turning now to the third modified embodiment of the luggage handle of this invention, attention is directed to FIG. 6, from which it can be appreciated that this embodiment of the invention is shown as generally being comprised of a handle 310, an intermediate member 312, and a strap portion 314.

A more careful consideration of the hand grasp 310 discloses that it features a hand contacting portion 320 and a base portion 322. Similar to the luggage handle of FIG. 3, this handle is preferably molded of plastic. Additionally, base portion 322 has formed at its midpoint an aperture 325. With respect to intermediate member 312, it features a first portion 330 at the center of which first portion 330 is formed an intermediate member aperture 338. Additionally, first portion 330 is shown having a pair of outer arms 332 and a pair of inner arms 334. Intermediate member 312 also features a two second portions 340 over which a longitudinal gasket 347 has been slipped so as to encase the strap attachment portion of the second portion. To facilitate the insertion of the strap attachment portion 344 into the interior of the gasket, the sidewall of the gasket 347 is provided with a slit not shown, but similar to 48, such that the exterior of the crossbar comes into contact with the interior surface of the gasket, just like in the embodiment discussed with reference to FIG. 3.

Fastening means 350 take the form of a grommet 352, positioned between the hand grasp and the intermediate member, and a post 356 with top 354 and bottom flange (not shown). In operative position, the fastening means 350 permits hand grasp 310 to rotate freely throughout 360° relative to the intermediate member 312. To phrase it another way, the hand grasp can be made to spin atop the intermediate member. Furthermore, the inclusion of rubber as the composition of choice for the grommet permits the hand grasp to pivot about the intermediate member as indicated by arrows P. Finally, strap portion 314 is fabricated from a fabric comprised in whole or in part of a hook and loop type of fastener substance known in the trade as VELCRO. The strap portion has a first side 360 and a second side 362 secured together by an appropriate fastening means 364 such a stitches or adhesive. Also it will be appreciated that first side 362 is shown as having a raised area 366 formed by gathering the fabric together in a manner well known in the sewing art, with this gathering best appreciated with reference to FIG. 4.

In this embodiment of the invention, the hand grasp is formed of molded plastic, the intermediate member of metal or plastic, and the fasteners and strap portion of metal or plastic, and fabric respectively.

Figure 7:
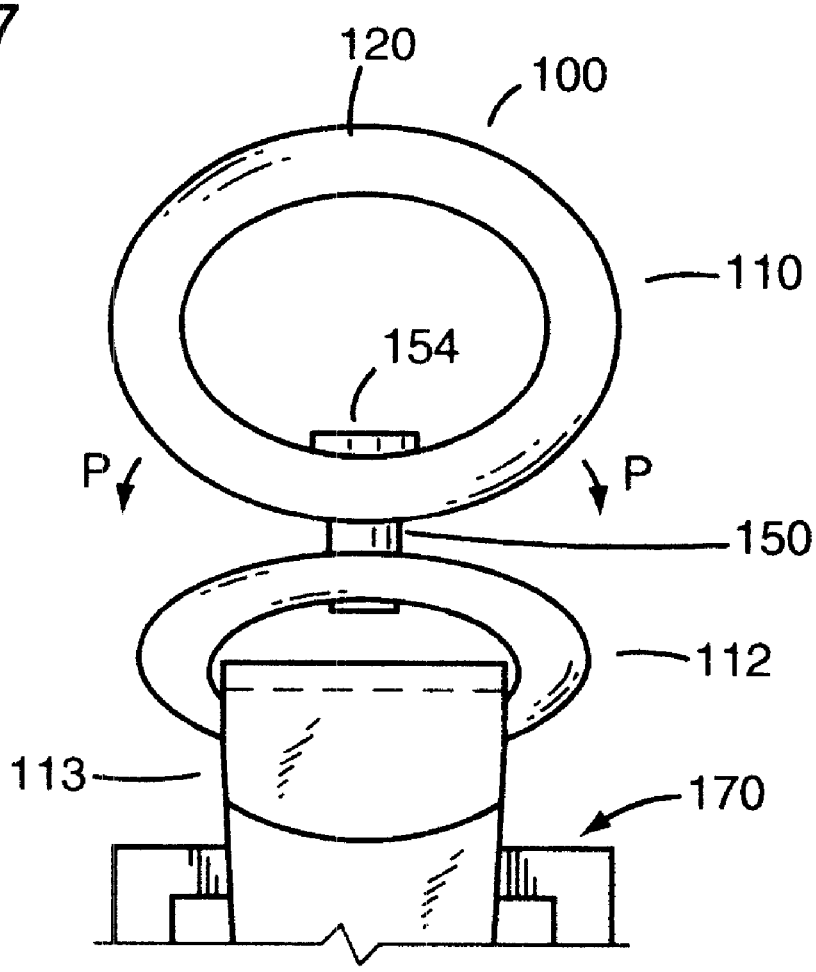
FIG. 7 is a front elevational view of the luggage handle of FIG. 3 operationally secured to the handle of a piece of luggage.

In actual use, the device has its strap portion wrapped about a handle. For illustrative purposes only one embodiment is disclosed in operative relationship with a handle 70, with that disclosure being in FIG. 7. The strap portion is wrapped upon itself so that the first side of the strap comes into contact with the second side. The hand grasp of the luggage handle of this invention thus rotates and pivots relative to the intermediate member, while in addition the intermediate member first portion rotates about the intermediate member second portion. As the strap is wrapped about the handle of a piece of luggage, the raised portion of the strap is made to fit snugly against the handle. This raised portion prevents the strap from slipping around the handle once it is secured thereto.

Thus it can be appreciated that in each of the embodiments of the invention, the strap attachment portion is spaced a distance below the top of the intermediate member, as well as being connected thereto. Further, as can readily be realized by reference to the drawings, in each embodiment an aperture (i.e. the strap attachment aperture) is formed between the strap attachment portion and the top of the intermediate member such that a section of the strap portion passes through the aperture so formed.

In cases where there is more than one strap attachment portion, each strap attachment portion is spaced a distance below the top of the intermediate member, as well as being connected thereto. Further, as can readily be realized by reference to the drawings, in those embodiments an aperture (i.e. the strap attachment aperture) is formed between each of the strap attachment portions and the top of the intermediate member such that a section of each strap portion passes through the respective aperture so formed.

The universal luggage handle of this invention, with its generally oval-shaped hand grasp as shown in the drawings, features a strap portion which is directly secured to itself at a location distinct from where the strap portion is secured to the intermediate member the strap portion is attached, the longitudinal axis of attachment can be appreciated in each of the embodiments shown as being located between the lowermost surface of the bottom the intermediate member and the hand grasp.

Therefore, not only is the universal luggage handle of this invention relatively easy to fabricate, but it is also very easy to utilize. Moreover, it permits a piece of luggage to easily change directions. While the form of apparatus herein described constitutes a preferred embodiment of this invention, it is to be understood that the invention is not limited to this precise form of apparatus and that changes may be made therein without departing from the scope of the invention which is defined in the appended claims.

What is claimed is:

1. A universal luggage handle for use in cooperation with a piece of luggage to effectuate the moving of the luggage, said universal luggage handle comprising a hand grasp, said hand grasp comprising a base portion, an intermediate member having a top surface, said intermediate member rotatably secured to said hand grasp, said hand grasp being separated from said intermediate member, said hand grasp secured to said intermediate member by first fastening means, said intermediate member comprising an intermediate member base portion and at least one strap attachment portion, and a strap portion, said strap portion secured to said intermediate member, said strap portion comprising second fastening means to secure said strap portion to itself, said at least one strap attachment portion being spaced a distance below said top surface of said intermediate member and connected thereto so as to create an aperture between said at least one strap attachment portion and said top surface of said intermediate member, a section of said strap portion passing through said aperture.

2. The luggage handle according to claim 1 wherein each said at least one strap attachment portion has a longitudinal axis of attachment associated therewith, said longitudinal axis located between the lowermost surface of the bottom of said intermediate member and said hand grasp, said strap portion free to rotate about said longitudinal axis.

3. The luggage handle according to claim 1 wherein said strap portion comprises a first side and a second side, said first side being generally planar, but having a raised portion.

4. The luggage handle according to claim 1 wherein said intermediate member comprises at least two strap attachment portions, and said luggage handle comprises at least two strap portions.

5. The luggage handle according to claim 4 wherein each said strap attachment portion has a longitudinal axis of attachment associated therewith, each said strap portion free to rotate about said longitudinal axis.

6. The luggage handle according to claim 4 wherein each said strap portion comprises a first side and a second side, said first side being generally planar, but having a raised portion.

7. A universal luggage handle for use in cooperation with a piece of luggage having a handle to effectuate the moving of the luggage, said universal luggage handle comprising a hand grasp, an intermediate member having a top surface, said intermediate member rotatably secured to said hand grasp, said hand grasp being separated from said intermediate member, said hand grasp secured to said intermediate member by first fastening means, said intermediate member comprising an intermediate member base portion and at least one strap attachment portion, and a strap portion, said strap portion secured to said intermediate member, said strap portion having a second fastening means to secure said strap portion to said intermediate member, said strap portion comprising a third fastening means to secure said strap portion to itself, said strap portion being secured directly to itself at a location distinct from where said strap portion is secured to said intermediate member.

8. The luggage handle according to claim 7 wherein each said strap attachment portion has a longitudinal axis of attachment associated therewith, said longitudinal axis located between the lowermost surface of the bottom of said intermediate member and said hand grasp, said strap portion free to rotate about said longitudinal axis.

9. The luggage handle according to claim 7 wherein said strap portion comprises a first side and a second side, said first side being generally planar, but having a raised portion.

10. The luggage handle according to claim 7 wherein said at least one strap attachment portion is spaced a distance below said top surface of said intermediate member and connected thereto so as to create an aperture between said at least one strap attachment portion and said top surface of said intermediate member, a section of said strap portion passing through said aperture.

11. The luggage handle according to claim 7 wherein said intermediate member comprises at least two strap attachment portions, and said luggage handle comprises at least two strap portions.

12. The luggage handle according to claim 11 wherein each said strap attachment portion has a longitudinal axis of attachment associated therewith, said longitudinal axis located between the lowermost surface of the bottom of said intermediate member and said hand grasp, each said strap portion free to rotate about said longitudinal axis.

13. The luggage handle according to claim 11 wherein each said strap portion comprises a first side and a second side, said first side being generally planar, but having a raised portion.

14. The luggage handle according to claim 11 wherein each said strap attachment portion is spaced a distance below said top surface of said intermediate member and connected thereto so as to create an aperture between each said strap attachment portion and said top surface of said intermediate member, a section of each said strap portion passing through each respective aperture.

* * * * *